US008426091B2

(12) United States Patent
Magome et al.

(10) Patent No.: US 8,426,091 B2
(45) Date of Patent: Apr. 23, 2013

(54) MAGNETIC TONER AND IMAGE-FORMING METHOD

(75) Inventors: Michihisa Magome, Mishima (JP); Tadashi Dojo, Numazu (JP); Eriko Yanase, Suntou-gun (JP); Takashi Matsui, Suntou-gun (JP); Tomohisa Sano, Suntou-gun (JP); Shuichi Hiroko, Sunsono (JP)

(73) Assignee: Canon Kabushiki Kaisha, Tokyo (JP)

( * ) Notice: Subject to any disclaimer, the term of this patent is extended or adjusted under 35 U.S.C. 154(b) by 702 days.

(21) Appl. No.: 12/260,890

(22) Filed: Oct. 29, 2008

(65) Prior Publication Data

US 2009/0117477 A1 May 7, 2009

(30) Foreign Application Priority Data

Oct. 31, 2007 (JP) ..... 2007-283128

(51) Int. Cl.
*G03G 13/04* (2006.01)

(52) U.S. Cl.
USPC ..... 430/48; 430/110.3; 430/111.41

(58) Field of Classification Search ..... 430/48, 430/110.3, 111.41
See application file for complete search history.

(56) References Cited

U.S. PATENT DOCUMENTS

| | | | | |
|---|---|---|---|---|
| 5,641,600 | A | 6/1997 | Kotaki et al. | 430/106.6 |
| 6,465,144 | B1 * | 10/2002 | Hashimoto et al. | 430/106.1 |
| 6,524,762 | B2 | 2/2003 | Tsutsui et al. | 430/108.8 |
| 6,593,051 | B1 | 7/2003 | Hirota et al. | 430/108.4 |
| 6,596,452 | B2 | 7/2003 | Magome et al. | 430/106.2 |
| 6,638,674 | B2 | 10/2003 | Komoto et al. | 430/106.1 |
| 7,361,442 | B2 | 4/2008 | Otake et al. | 430/122.5 |
| 7,415,230 | B2 | 8/2008 | Kawamura et al. | 399/265 |
| 7,486,914 | B2 | 2/2009 | Kabata et al. | |
| 2002/0106574 | A1 * | 8/2002 | Haneda et al. | 430/124 |
| 2005/0217536 | A1 * | 10/2005 | Takagi | 106/31.65 |
| 2008/0226997 | A1 * | 9/2008 | Nakamura et al. | 430/48 |

FOREIGN PATENT DOCUMENTS

| | | |
|---|---|---|
| JP | 7-271090 A | 10/1995 |
| JP | 2000-047428 | 2/2000 |
| JP | 2002-251037 A | 9/2002 |
| JP | 2003-043738 | 2/2003 |
| JP | 2006-330562 A | 12/2006 |

OTHER PUBLICATIONS

Patent Abstracts of Japan for JP 04-067045, Mar. 3, 1992.

* cited by examiner

*Primary Examiner* — Thorl Chea
(74) *Attorney, Agent, or Firm* — Fitzpatrick, Cella, Harper & Scinto

(57) ABSTRACT

To solve a thin image density and sweeping occurring when a toner carrying member having a small diameter is used, provided is an image-forming method including: a charging step; an electrostatic latent image-forming step; a developing step; a transferring step; and a fixing step, in which a magnetic toner to be used in the method has a specific weight average particle diameter (D4); the magnetic toner has a specific intensity of magnetization in a specific magnetic field; and a surface free energy of a surface of the magnetic toner and a surface free energy of a surface of a toner carrying member to be used in the method satisfy specific relationships.

5 Claims, 1 Drawing Sheet

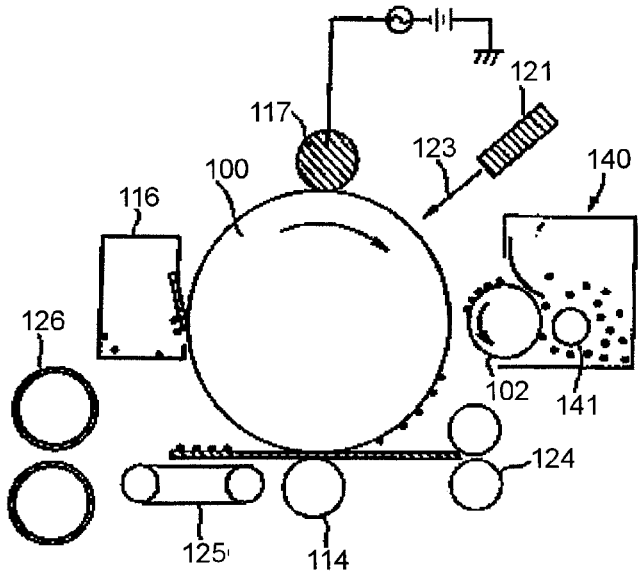
121
117
123
140
100
116
126
102
141
124
125
114

MAGNETIC TONER AND IMAGE-FORMING METHOD

BACKGROUND OF THE INVENTION

1. Field of the Invention

The present invention relates to a toner to be used in a recording method utilizing an electrophotographic method or the like, and an image-forming method.

2. Description of the Related Art

Various electrophotographic methods have been known. A general electrophotographic method involves the utilization of a photoconductive substance, and includes: forming an electrostatic latent image on an electrostatic image bearing member (which may hereinafter be referred to as "photosensitive member") by various means; developing the latent image with toner to provide a visible image; transferring the toner image onto a recording medium such as paper as required; and fixing the toner image on the recording medium with heat, pressure, or the like to provide a copied article. An image-forming apparatus which adopts such electrophotographic method is, for example, a copying machine or a printer. In recent years, such printer or copying machine has showed a shift from image formation in an analog fashion to image formation in a digital fashion, and hence has been strongly requested to have an additionally increased speed and an additionally reduced size as well as to show excellent reproducibility of a latent image and a high resolution.

Here, attention is paid to the reduction in size. A reduction in diameter of, for example, a latent image bearing member or toner carrying member in an image-forming step is an essential condition for the reduction in size. In addition, a reduction in diameter of the toner carrying member increases the number of times of contact between toner and a toner control member, whereby a uniform charge quantity is provided for the toner, and, at the same time, the toner carrying member is uniformly coated with the toner. As a result, an improvement in quality of an image formed with the toner can be expected.

However, the reduction in diameter of the latent image bearing member or toner carrying member means that the curvature of the bearing member or carrying member increases, and involves the emergence of the following detrimental effect: a developing zone becomes extremely narrow in a developing portion. Particularly in jumping development as magnetic, one-component development, a narrow developing zone causes the following problem: the amount of toner to be developed reduces, so a sufficient image density cannot be obtained.

In addition, the following phenomenon also known as "sweeping" is known to occur in the jumping development: an electric line of force orients toward a solid black edge portion in a boundary region between a solid black portion and a solid white portion, so the amount of toner with which the edge portion is developed increases. The phenomenon is known to occur at a site where a distance between an electrostatic latent image bearing member and a toner carrying member (hereinafter abbreviated as "S-D distance") rapidly increases, that is, the rear end of a developing zone, and generally occurs remarkably when a toner carrying member or electrostatic latent image bearing member having a large curvature is used.

To cope with the phenomenon, it has been reported that sweeping can be alleviated by inserting a plate-like member into a developing zone (Japanese Patent Application Laid-Open No. 2005-077702 A). However, when a toner carrying member having a small diameter is used, the following problem is apt to arise: the insertion of the plate-like member into the developing zone additionally narrows the developing zone, with the result that an image to be formed hardly shows a high density.

Although a sufficient image density can be obtained by extending the developing zone by certain means, an abrupt increase in the S-D distance at the rear end portion of the developing zone occurs, so sweeping may be additionally remarkable.

As described above, there is a trade-off between an image density and sweeping when a toner carrying member having a small diameter is used.

Attempts have been made to alleviate those problems by controlling the flowability of magnetic toner. For example, the degree of agglomeration of the toner is adjusted (Japanese Patent Application Laid-Open No. 2003-43738 A), or the compressibility of the toner is controlled (Japanese Patent Application Laid-Open No. 2000-181128 A or Japanese Patent Application Laid-Open No. 2001-356516 A). Further, a toner having an adjusted contact angle with water has been proposed (Japanese Patent Application Laid-Open No. H04-067045 A or Japanese Patent Application Laid-Open No. 2000-047428 A), but is still susceptible to improvement in terms of an increase in density of an image formed with the toner and the alleviation of sweeping when the toner is combined with a toner carrying member having a small diameter.

SUMMARY OF THE INVENTION

The present invention has been made in view of the above problems of the prior art, and an object of the present invention is to solve a thin image density and sweeping occurring when a toner carrying member having a small diameter is used.

An image-forming method including: a charging step of charging an electrostatic latent image bearing member with a charging member to which a voltage is applied; an electrostatic latent image-forming step of writing image information as an electrostatic latent image on the charged electrostatic latent image bearing member; a developing step involving forming a toner layer on a toner carrying member carrying magnetic toner and having an outer diameter of 8.0 mm or more and less than 12.0 mm with a toner layer thickness control member brought into abutment with the toner carrying member, and dislocating the magnetic toner to the electrostatic latent image in a developing portion which is formed by placing the electrostatic latent image bearing member and the toner carrying member with a gap between the electrostatic latent image bearing member and the toner carrying member and to which an alternating electric field is applied to form a toner image; a transferring step of transferring the formed toner image onto a recording medium; and a fixing step of fixing the transferred toner image, the electrostatic latent image bearing member repeatedly undergoing image formation on itself, in which the magnetic toner has a weight average particle diameter (D4) of 8.0 μm or more and 14.0 μm or less; the magnetic toner has an intensity of magnetization in a magnetic field of 79.6 kA/m (1,000 Oe) of 16.0 $Am^2/kg$ or more and 25.0 $Am^2/kg$ or less; and when a surface free energy of a surface of the magnetic toner is represented by A ($mJ/m^2$) and a surface free energy of a surface of the toner carrying member is represented by X ($mJ/m^2$), A and X satisfy the following expressions (1) and (2):

$$1.00 \leqq X/A \leqq 4.00 \quad (1)$$

$$10.0 mJ/m^2 \leqq A \leqq 55.0 mJ/m^2. \quad (2)$$

According to a preferred embodiment of the present invention, an image having the following characteristics can be obtained even when the toner of the present invention is combined with a toner carrying member having a small diameter: the image has a high density, causes no sweeping, and is vivid.

Further features of the present invention will become apparent from the following description of exemplary embodiments (with reference to the attached drawings).

BRIEF DESCRIPTION OF THE DRAWINGS

FIG. 1 is a schematic sectional view showing an example of an image-forming apparatus in which a toner of the present invention can be suitably used.

DESCRIPTION OF PREFERRED EMBODIMENT

An image-forming method of the present invention includes: a charging step of charging an electrostatic latent image bearing member with a charging member to which a voltage is applied; an electrostatic latent image-forming step of writing image information as an electrostatic latent image on the charged electrostatic latent image bearing member; a developing step involving forming a toner layer on a toner carrying member carrying magnetic toner and having an outer diameter of 8.0 mm or more and less than 12.0 mm with a toner layer thickness control member brought into abutment with the toner carrying member, and dislocating the magnetic toner to the electrostatic latent image in a developing portion which is formed by placing the electrostatic latent image bearing member and the toner carrying member with a gap between the electrostatic latent image bearing member and the toner carrying member and to which an alternating electric field is applied to form a toner image; a transferring step of transferring the formed toner image onto a recording medium; and a fixing step of fixing the transferred toner image, the electrostatic latent image bearing member repeatedly undergoing image formation on itself, in which the magnetic toner has a weight average particle diameter (D4) of 8.0 μm or more and 14.0 μm or less; the magnetic toner has an intensity of magnetization in a magnetic field of 79.6 kA/m (1,000 Oe) of 16.0 $Am^2/kg$ or more and 25.0 $Am^2/kg$ or less; and when a surface free energy of a surface of the magnetic toner is represented by A ($mJ/m^2$) and a surface free energy of a surface of the toner carrying member is represented by X ($mJ/m^2$), A and X satisfy the following expressions (1) and (2):

$$1.00 \leqq X/A \leqq 4.00 \quad (1)$$

$$10.0 mJ/m^2 \leqq A \leqq 55.0 mJ/m^2. \quad (2)$$

In addition, a magnetic toner of the present invention is used in an image-forming method including: a charging step of charging an electrostatic latent image bearing member with a charging member to which a voltage is applied; an electrostatic latent image-forming step of writing image information as an electrostatic latent image on the charged electrostatic latent image bearing member; a developing step involving forming a toner layer on a toner carrying member carrying the magnetic toner and having an outer diameter of 8.0 mm or more and less than 12.0 mm with a toner layer thickness control member brought into abutment with the toner carrying member, and dislocating the magnetic toner to the electrostatic latent image in a developing portion which is formed by placing the electrostatic latent image bearing member and the toner carrying member with a gap between the electrostatic latent image bearing member and the toner carrying member and to which an alternating electric field is applied to form a toner image; a transferring step of transferring the formed toner image onto a recording medium; and a fixing step of fixing the transferred toner image, the electrostatic latent image bearing member repeatedly undergoing image formation on itself, in which the magnetic toner has a weight average particle diameter (D4) of 8.0 μm or more and 14.0 μm or less; the magnetic toner has an intensity of magnetization in a magnetic field of 79.6 kA/m (1,000 Oe) of 16.0 $Am^2/kg$ or more and 25.0 $Am^2/kg$ or less; and when a surface free energy of a surface of the magnetic toner is represented by A ($mJ/m^2$) and a surface free energy of a surface of the toner carrying member is represented by X ($mJ/m^2$), A and X satisfy the following expressions (1) and (2):

$$1.00 \leqq X/A \leqq 4.00 \quad (1)$$

$$10.0 mJ/m^2 \leqq A \leqq 55.0 mJ/m^2. \quad (2)$$

When such toner carrying member having a small diameter as described above is used, a sufficient image density is hardly obtained because the amount of toner to be developed reduces owing to the narrowing of a developing zone. On the other hand, the extension of the developing zone promotes sweeping. In view of the foregoing, the inventors of the present invention have investigated how compatibility between an image density and sweeping is achieved on conditions that the developing efficiency of the toner is improved while a narrow developing zone is maintained and that the amount of the toner to be developed is increased while the developing zone remains nearly unextended.

In view of the foregoing, the inventors have made studies from the viewpoint of an improvement in developing efficiency. As a result, the inventors have found that the above problems can be solved when the following conditions (1) to (3) are satisfied, and have reached the present invention:

(1) the magnetic toner (which may hereinafter be simply referred to as "toner") has a weight average particle diameter (D4) of 8.0 μm or more and 14.0 μm or less;

(2) the magnetic toner has an intensity of magnetization in a magnetic field of 79.6 kA/m (1,000 Oe) of 16.0 $Am^2/kg$ or more and 25.0 $Am^2/kg$ or less; and (3) when the surface free energy of the surface of the magnetic toner is represented by A ($mJ/m^2$) and the surface free energy of the surface of the toner carrying member is represented by X ($mJ/m^2$), A and X satisfy the following expressions (1) and (2):

$$1.00 \leqq X/A \leqq 4.00 \quad (1)$$

$$10.0 mJ/m^2 \leqq A \leqq 55.0 mJ/m^2. \quad (2)$$

First, the condition (1), i.e., the weight average particle diameter of the toner will be described. As the weight average particle diameter of the toner increases, a reflection force between the toner and the toner carrying member reduces, so the development of the toner is facilitated. Accordingly, it is important for the weight average particle diameter (D4) of the toner to be 8.0 μm or more.

On the other hand, when the weight average particle diameter of the toner is larger than 14.0 μm, the development of the toner is excessively facilitated, so the developing zone extends and sweeping becomes remarkable. Accordingly, in the present invention, the weight average particle diameter (D4) of the magnetic toner is 8.0 μm or more and 14.0 μm or less, or preferably 9.0 μm or more and 14.0 μm or less. It should be noted that the above weight average particle diameter (D4) of the magnetic toner can be adjusted to fall within the above range by changing conditions for the production of the toner (such as a condition for pulverization and a condition for classification).

Next, the intensity of magnetization of the magnetic toner in a magnetic field of 79.6 kA/m (1,000 Oe) will be described. As the intensity of magnetization of the toner reduces, the developing efficiency of the toner is improved because the toner does not receive any magnetic force of constraint from a magnet roller in the toner carrying member. Accordingly, in the present invention, the intensity of magnetization of the magnetic toner is 25.0 $Am^2/kg$ or less. However, an intensity of magnetization of the magnetic toner of less than 16.0 $Am^2/kg$ is not preferable because even toner which cannot be sufficiently charged is developed and the development causes an increase in fogging. Accordingly, the intensity of magnetization of the magnetic toner is 16.0 $Am^2/kg$ or more and 25.0 $Am^2/kg$ or less, or preferably 18.0 $Am^2/kg$ or more and 25.0 $Am^2/kg$ or less.

Next, the state of the toner on the toner carrying member will be discussed. The toner forms "spikes" on the toner carrying member along magnetic lines of force. In addition, the "spikes" of the toner on the toner carrying member each have a length of about 100 to 200 μm. In many cases, however, the tips of the "spikes" each having a length of about several tens of micrometers are developed in an actual developing zone, so not all the toner on the toner carrying member is developed.

Here, the surface free energy of the toner will be described. In general, toner having a small surface free energy shows good releasing performance. Accordingly, a state where the surface free energy of the toner is low may mean that releasing performance between the particles of the toner is good, that is, the particles of the toner can be easily loosened.

Accordingly, when the surface free energy of the surface of the toner is 55.0 $mJ/m^2$ or less, the following situation can be assumed: the "spikes" of the toner on the toner carrying member are finely loosened by a developing bias, so even toner near the toner carrying member can be developed, and the developing efficiency of the toner is improved.

Further, the toner carrying member to be used in the present invention has a large curvature because its outer diameter is less than 12.0 mm. As a result, the following situation can be assumed: although the "spikes" of the toner are densely present at a portion of the toner in contact with the toner carrying member, a space near the tips of the "spikes" is relatively wide, so a broad state is established. Accordingly, by virtue of a synergistic effect of the fact that the surface free energy of the surface of the toner is low and the fact that the vicinities of the tips of the "spikes" are broad, the ease with which the toner is loosened is improved, and the developing efficiency is additionally improved.

On the other hand, toner the surface of which has a surface free energy in excess of 55.0 $mJ/m^2$ behaves as "spikes" even in a developing zone because releasing performance between the particles of the toner is bad. As a result, the developing efficiency of the toner is not improved, and it becomes difficult to obtain a sufficient image density.

As described above, in the present invention, the surface free energy [A] of the surface of the magnetic toner is 55.0 $mJ/m^2$ or less, or preferably 45.0 $mJ/m^2$ or less.

On the other hand, a surface free energy [A] of the surface of the toner of less than 10.0 $mJ/m^2$ is not preferable because of the following reason: friction between the toner and a charging member cannot be successfully performed, and the charge quantity distribution of the toner becomes broad owing to the excessively low surface free energy, so an increase in fogging occurs. Accordingly, in the present invention, the surface free energy [A] of the surface of the magnetic toner is 10.0 $mJ/m^2$ or more and 55.0 $mJ/m^2$ or less, preferably 15.0 $mJ/m^2$ or more and 45.0 $mJ/m^2$ or less, or still more preferably 15.0 $mJ/m^2$ or more and 40.0 $mJ/m^2$ or less.

In addition, when the surface free energy of the surface of the toner carrying member is represented by X ($mJ/m^2$), A and X should satisfy the relationship of $1.00 \leqq X/A \leqq 4.00$. This is because of the following reason: even when such surface free energy of the surface of the toner as described above is lowered, the developing efficiency of the toner is not improved as long as the surface free energy of the surface of the toner carrying member which the toner contacts is high (the ratio X/A is larger than 4.00). That is, adjusting a ratio between the surface free energy of the surface of the toner and the surface free energy of the toner carrying member achieves good release of the toner from the surface of the toner carrying member, and additionally improves the developing efficiency.

However, the case where the surface free energy of the surface of the toner carrying member is lower than the surface free energy of the surface of the toner (the ratio X/A is less than 1.00) is not preferable because the toner is poor in transporting performance and triboelectric charging performance, and a reduction in developing performance of the toner, an increase in fogging, or the like occurs. Accordingly, the ratio X/A is 1.00 or more and 4.00 or less, or preferably 1.05 or more and 3.50 or less.

As described above, a synergistic effect of the following three points achieved in the above conditions (1) to (3) with a view to improving the developing efficiency of the toner has improved the developing efficiency without extending a developing zone, and has allowed one to obtain an image causing no sweeping and having a high density:

(1) a reduction in reflection force due to the particle diameter of the toner;

(2) the optimization of a magnetic force of constraint; and (3) the ease with which the toner is loosened and high releasing performance of the toner from the surface of the toner carrying member.

In the present invention, the residual magnetization of the magnetic toner when the magnetic toner is polarized in a magnetic field of 79.6 kA/m (1,000 Oe) is preferably 3.00 $Am^2/kg$ or less, or more preferably 2.50 $Am^2/kg$ or less.

Such toner of the present invention as described above can be easily loosened because of its low surface free energy; a residual magnetization of the toner of 3.00 $Am^2/kg$ or less is preferable because of the following reason: since magnetic agglomeration of the toner is mitigated, the ease with which the toner is loosened is improved, whereby the above-mentioned effect becomes additionally significant, and the density of an image formed with the toner becomes high.

As a result, the residual magnetization of the magnetic toner when the magnetic toner is polarized in a magnetic field of 79.6 kA/m (1,000 Oe) is preferably 3.00 $Am^2/kg$ or less.

In the present invention, an average circularity of the magnetic toner is preferably 0.950 or more, and a mode circularity of the magnetic toner is preferably 0.96 or more.

When the average circularity of the toner is 0.950 or more, the toner is of a spherical shape or a nearly spherical shape, so the toner is excellent in flowability and can easily obtain uniform triboelectric charging performance. When the toner is excellent in flowability and has uniform triboelectric charging performance as described above, a synergistic effect of the foregoing and the fact that the surface free energy of the surface of the toner is low improves the developing efficiency, whereby a high image density can be obtained. On the foregoing condition, a mode circularity in the circularity distribution of the toner of 0.96 or more is additionally preferable because the above effect becomes additionally significant. It should be noted that each of the average circularity and the mode circularity described above can satisfy the above range by adjusting, for example, conditions for the production of the toner.

The toner of the present invention is composed of toner particles each containing at least a binder resin and a magnetic substance, and an additive such as an inorganic fine powder to be added to the toner particles as required. The toner of the present invention can be produced by any one of the known methods. When the toner is produced by a pulverization method, the toner particles can be obtained by: sufficiently mixing components essential for the toner such as the binder resin and the magnetic substance, and, for example, a release agent, a charge control agent, and any other additive with a mixer such as a Henschel mixer or a ball mill; melting and kneading the mixture with a heat kneader such as a heat roller, a kneader, or an extruder to disperse or dissolve the toner materials; cooling the resultant to solidify the resultant; pulverizing the solidified product; classifying the pulverized products; and treating the surface of each of the classified products as required. The classification may be performed prior to the surface treatment, and vice versa. A multi-division classifier is preferably used in the classifying step in terms of production efficiency.

The pulverizing step can be performed by means of a conventionally known pulverizer such as a mechanical impact type pulverizer or a jet type pulverizer. To obtain the toner of the present invention having a preferred circularity, the solidified product is preferably pulverized under heat or a mechanical impact is preferably applied to the solidified product in an auxiliary manner. A hot water bath method involving dispersing finely pulverized toner particles (classified as required) into hot water, a method involving passing the particles through a heat air current, or the like may be adopted.

An example of a method of applying a mechanical impact includes a method involving the use of a mechanical impact type pulverizer such as a Kryptron system manufactured by Kawasaki Heavy Industries, Ltd. or a Turbo mill manufactured by Turbo Kogyo Co., Ltd. Alternatively, a method involving the use of a device such as a Mechanofusion System manufactured by Hosokawa Micron Corp. or a Hybridization System manufactured by Nara Machinery Co., Ltd. to press toner against the inside of a casing by means of a blade rotating at a high speed by virtue of a centrifugal force, to thereby apply a mechanical impact to the toner by virtue of a force such as a compressive force or a frictional force is exemplified.

In the present invention, the surface free energy of the surface of the toner can be arbitrarily changed by adjusting a resin or a release agent to be used, or a method of producing the toner.

To be specific, the surface free energy of the surface of the toner can be changed by: applying heat to the toner at the time of the production of the toner to cause the release agent to exude to the surface of the toner; or using a resin having a low free energy.

Of such resins, a silicone resin or a fluorine-based resin is preferably used in order that the surface free energy of the surface of the toner may be adjusted. The surface free energy of the surface of the toner can be arbitrarily adjusted by changing the abundance of any such resin on the surface of the toner because the resin has a lower free energy than that of the binder resin of the toner.

A method involving the use of any such resin is, for example, a method involving internally adding the resin to the inside of the toner, or a method involving externally adding the resin as an additive to each toner particle to immobilize the resin; the method involving externally adding the resin to immobilize the resin is preferable because the abundance of the resin on the surface of the toner can be easily controlled.

The method involving internally adding the above resin to the inside of the toner is, for example, a method involving: mixing the above resin with the binder resin, the magnetic substance, and any other required raw material at the time of the production of the toner; and melting and kneading the mixture as described above to provide the toner.

In addition, the method involving externally adding the above resin as an additive to each toner particle is, for example, a method involving mixing the toner particles with a resin powder of the above resin under stirring to provide the toner. Further, it is additionally desirable that the resin be immobilized by applying, for example, a mechanical impact force or heat to the product thus obtained.

As a fluorine-based resin that can be used in the present invention include copolymers in which polyvinyl fluoride, polyvinylidene fluoride, polytrifluoroethylene, polychlorotrifluoroethylene, polydichlorodifluoroethylene, polytetrafluoroethylene, or polyhexafluoropropylene and another monomer is copolymerized.

Examples of the silicone resin include KR271, KR282, KR311, KR255, and KR 155 (straight silicone varnish), KR211, KR212, KR216, KR213, KR217, and KR9218 (silicone varnish for modification), SA-4, KR206, and KR5206 (silicone alkyd varnish), ES1001, ES1001N, ES1002T, and ES1004 (silicone epoxy varnish), KR9706 (silicone acryl varnish), KR5203, KR5221 (silicone polyester varnish), all of which are manufactured by Shin-Etsu Chemical Co., Ltd. and SR2100, SR2101, SR2107, SR2110, SR2108, SR2109, SR2400, SR2410, SR2411, SH805, SH806A, and SH840, all of which are manufactured by Dow Corning Toray Co., Ltd., and TOSPEARL manufactured by Momentive Performance Materials Inc., and the like are used.

Such fluorine-based resin or silicone resin is added in an amount of preferably 0.1 part by mass or more and 20.0 parts by mass or less with respect to 100 parts by mass of the binder resin.

Examples of a binder resin to be used in the magnetic toner of the present invention include: homopolymers of styrene and of a substituted product thereof such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a polyester resin, a polyamide resin, an epoxy resin, and a polyacrylic resin. Each of them can be used alone, or two or more of them can be used in combination.

Of those, a styrene-based copolymer and a polyester resin are particularly preferable in terms of developing property, fixability, and the like.

The magnetic substance to be used in the magnetic toner of the present invention is mainly composed of a magnetic iron oxide such as triiron tetroxide or γ-iron oxide, and may contain an element such as phosphorus, cobalt, nickel, copper, magnesium, manganese, aluminum, or silicon.

The magnetic substance has a BET specific surface area according to a nitrogen adsorption method of preferably 2 to 30 $m^2/g$, or more preferably 3 to 28 $m^2/g$.

In addition, the magnetic substance preferably has a Mohs hardness of 5 to 7. Examples of the shape of the magnetic substance include a polygonal shape, an octahedral shape, a hexagonal shape, a spherical shape, a needle-like shape, and a flaky shape. Of those, a shape having low anisotropy such as a polygonal shape, an octahedral shape, a hexagonal shape, or a spherical shape is preferable for increasing an image density.

The volume average particle size (DV) of the magnetic substance is preferably 0.10 to 0.40 μm. In general, a magnetic substance having a smaller particle size is likely to aggregate, so the uniform dispersibility of the magnetic substance in toner deteriorates, although the magnetic substance has higher coloring power. In addition, a magnetic substance having a volume average particle size (DV) of less than 0.10 μm itself is likely to have a reddish black color, so an image (especially a half tone image) to be formed by means of toner containing the magnetic substance is remarkably reddish and may not have high quality. On the other hand, a magnetic substance having a volume average particle size (DV) in excess of 0.40 μm is likely to provide toner with insufficient coloring power.

It should be noted that the volume average particle size (DV) of the magnetic substance can be measured by means of a transmission electron microscope. A specific method involves: sufficiently dispersing toner particles to be observed into an epoxy resin; curing the resultant for 2 days in an environment having a temperature of 40° C.; cutting the resultant cured product into a flaky sample by means of a microtome; observing the photograph of the sample at a magnification of ×10,000 to 40,000 by means of a transmission electron microscope (TEM) to measure the particle sizes of 100 magnetic substance particles in the field of view; and calculating a volume average particle size (DV) on the basis of the equivalent diameter of a circle equal to the projected area of the magnetic substance. A particle size can also be measured by means of an image analyzer.

The magnetic substance to be used in the magnetic toner of the present invention has an intensity of magnetization in a magnetic field of 79.6 kA/m of preferably 30 to 120 $Am^2/kg$. When the intensity of magnetization is less than 30 $Am^2/kg$, the following tendency is observed: the fogging of the toner increases, or the density of an image formed with the toner becomes low owing to insufficient transport of the toner. On the other hand, when the intensity of magnetization exceeds 120 $Am^2/kg$, the following tendency is observed: a magnetic force of constraint between the toner and the toner carrying member strengthens so that the developing efficiency of the toner reduces.

It should be noted that the intensity of magnetization and residual magnetization of the toner can be arbitrarily changed in accordance with the content of the magnetic substance, and the intensity of magnetization and residual magnetization of the magnetic substance.

In the present invention, the intensity of magnetization and residual magnetization of each of the magnetic toner and the magnetic substance are measured with an oscillation type magnetometer VSM P-1-10 (manufactured by TOEI INDUSTRY CO., LTD.) at room temperature, i.e., 25° C. in an external magnetic field of 79.6 kA/m (1,000 Oe). This is because of the following reason: the behavior of the toner in a developing zone can be grasped by measuring the intensity of magnetization and residual magnetization of each of the toner and the magnetic substance in an external magnetic field of 79.6 kA/m as the magnetic force of the developing pole of a magnet roller fixed in the toner carrying member is generally around 79.6 kA/m (1,000 Oe).

The magnetic substance to be incorporated into the toner of the present invention can be produced by means of, for example, the following method.

An alkali such as sodium hydroxide is added in an amount equivalent to or more than an iron component of an aqueous solution of a ferrous salt to the solution, to thereby prepare an aqueous solution containing ferrous hydroxide. Air is blown while the pH of the prepared aqueous solution is maintained at 7 or more, and an oxidation reaction of ferrous hydroxide is performed while the aqueous solution is heated to 70° C. or higher. Thus, a seed crystal serving as a core of a magnetic iron oxide powder is first produced.

Next, an aqueous solution containing about 1 equivalent of ferrous sulfate based on the amount of the alkali previously added is added to a slurry-like liquid containing the seed crystal. Air is blown while the pH of the liquid is maintained at 5 to 10, and a reaction of ferrous hydroxide is advanced to grow the magnetic iron oxide powder with the seed crystal as a core. At this time, the shape and magnetic properties of the magnetic substance can be controlled by arbitrarily selecting a pH, a reaction temperature, and a stirring condition. As the oxidation reaction proceeds, the pH of the liquid shifts to lower values. However, the pH of the liquid is not preferably less than 5. The magnetic substance thus obtained is filtered, washed, and dried according to an ordinary method to provide a magnetic substance.

The magnetic substance to be used in the toner of the present invention is used in an amount of preferably 20 to 150 parts by mass with respect to 100 parts by mass of the binder resin. When the addition amount of the magnetic substance is less than 20 parts by mass, the coloring power of the toner is poor, so it may be difficult to suppress fogging. On the other hand, when the addition amount exceeds 150 parts by mass, holding power on the toner by the magnetic force of the toner carrying member strengthens, so the developing performance of the toner tends to reduce.

It should be noted that the content of the magnetic substance in the toner can be measured with an apparatus for thermogravimetry TGA7 manufactured by PerkinElmer Co., Ltd. A method for the measurement is as described below. The toner is heated from normal temperature to 900° C. at a rate of temperature increase of 25° C./min under a nitrogen atmosphere. The percentage (mass %) by which the mass of the toner reduced during the temperature increase from 100° C. to 750° C. is defined as the amount of the binder resin, and the remaining mass is approximately defined as the amount of a magnetic powder.

The magnetic toner of the present invention, which contains the magnetic substance as a colorant, can use any one of the known organic pigments or dyes together with the magnetic substance. A colorant that can be used in combination with the magnetic substance except the above known dyes and pigments is, for example, a magnetic or non-magnetic inorganic compound. Specific examples of the magnetic or non-magnetic inorganic compound include: ferromagnetic metal particles each made of, for example, cobalt or nickel; alloys each obtained by adding, for example, chromium, manganese, copper, zinc, aluminum, or a rare earth element to any such ferromagnetic metal; particles each made of, for example, hematite; titanium black; a nigrosin dye/pigment; carbon black; and phthalocyanine.

In addition, the above colorant is added in an amount of preferably 1 to 20 parts by mass with respect to 100 parts by mass of the binder resin.

The magnetic toner of the present invention has a glass transition temperature (Tg) of preferably 40 to 70° C. When the glass transition temperature is lower than 40° C., the storage stability of the toner tends to reduce, and the toner is apt to deteriorate when used over a long time period. When the glass transition temperature is higher than 70° C., the fixing performance of the toner tends to reduce. Accordingly, the glass transition temperature of the toner is preferably 40 to 70° C. in consideration of a balance among the fixing performance, storage stability, and developing performance of the toner.

The magnetic toner of the present invention may be blended with a charge control agent as required in order that the charging characteristic of the toner may be improved. A known agent can be utilized as the charge control agent; a charge control agent which allows the toner to be charged at a high speed and to be capable of stably maintaining a constant charge quantity is particularly preferable.

Specific examples of a charge control agent to serve as a negative charge control agent include: metal compounds of aromatic carboxylic acids such as salicylic acid, alkyl salicylic acid, dialkyl salicylic acid, naphthoic acid, and dicarboxylic acid; metal salts or metal complexes of azo dyes or of azo pigments; polymeric compounds each having a sulfonic acid or a carboxylic acid at a side chain thereof; boron compounds; urea compounds; silicon compounds; and calixarene. On the other hand, specific examples of a charge control agent to serve as a positive charge control agent include: quaternary ammonium salts; polymeric compounds having the quaternary ammonium salts at their side chains; guanidine compounds; nigrosin-based compounds; and imidazole compounds.

The amount in which such charge control agent is used is determined by the kind of the binder resin, the presence or absence of any other additive, and a method of producing the toner including a method of dispersing materials for the toner, and is not uniquely defined. However, when the charge control agent is internally added to each toner particle, the charge control agent is used in an amount in the range of preferably 0.1 to 10.0 parts by mass, or more preferably 0.1 to 5.0 parts by mass with respect to 100 parts by mass of the binder resin.

In addition, when the charge control agent is externally added to each toner particle, the charge control agent is used in an amount of preferably 0.005 to 1.000 part by mass, or more preferably 0.010 to 0.300 part by mass with respect to 100 parts by mass of the toner.

The magnetic toner of the present invention may contain a release agent in order that the fixing performance of the toner may be improved. The magnetic toner contains the release agent at a content of preferably 1.0 mass % or more and 30.0 mass % or less, or more preferably 3.0 mass % or more and 25.0 mass % or less with respect to the binder resin.

When the content of the release agent is less than 1.0 mass %, a suppressing effect of the release agent on cold offset becomes poor. When the content exceeds 30.0 mass %, the long-term storage stability of the toner tends to reduce, and the charging uniformity of the toner may reduce owing to, for example, the exudation of the release agent to the surface of the toner, with the result that a reduction in transfer efficiency of the toner tends to occur.

Examples of the releasing agent include: petroleum-based waxes such as a paraffin wax, a microcrystalline wax, and petrolactum, and derivatives thereof; a montan wax and a derivative thereof; a hydrocarbon-based wax according to a Fischer-Tropsch method and a derivative thereof; polyolefin waxes typified by polyethylene and derivatives thereof; and natural waxes such as a carnauba wax and a candelilla wax, and derivatives thereof. The derivatives include oxides, block copolymers with vinyl-based monomers, and graft denatured products. Further, examples of a releasing agent that can be used include: higher aliphatic alcohols; aliphatic acids such as stearic acid and palmitic acid, and compounds thereof; acid amide waxes; ester waxes; ketones; a hardened castor oil and a derivative thereof; plant waxes; and animal waxes.

In the present invention, an inorganic fine powder having a number average primary particle diameter of preferably 4 to 80 nm, or more preferably 6 to 40 nm is added as a flowability-imparting agent to the particles of the magnetic toner. The inorganic fine powder is added for improving the flowability of the toner and uniformizing the charging of the toner. It is also preferable that the inorganic fine powder be subjected to a hydrophobic treatment so as to have a function such as the adjustment of the charge quantity of the toner or an improvement in environmental stability of the toner.

When the number average primary particle diameter of the inorganic fine powder is larger than 80 nm, or no inorganic fine powder having a number average primary particle diameter of 80 nm or less is added, it tends to be difficult for the toner to obtain good flowability, so the toner is apt to be nonuniformly provided with charge. On the other hand, when the number average primary particle diameter of the inorganic fine powder is smaller than 4 nm, the agglomerating performance of the inorganic fine powder strengthens, so the inorganic fine powder is apt to behave not as primary particles but as an agglomerate which: has so strong agglomerating performance as to be hardly loosened even by a shredding treatment; and shows a wide grain size distribution. As a result, image defects due to the development of the agglomerate or to damage done by the agglomerate to an electrostatic latent image bearing member, toner carrying member, or the like are apt to occur.

In the present invention, the number average primary particle diameter of the inorganic fine powder is measured with the photograph of the toner provided by a scanning electron microscope at a certain magnification.

Examples of the above inorganic fine powder include a silica fine powder, a titanium oxide fine powder, and an alumina fine powder. For example, each of both dry silica also referred to as dry process silica or fumed silica produced by the vapor-phase oxidation of a silicon halide and the so-called wet silica produced from, for example, water glass can be used as the silica fine powder. However, the dry silica is preferable because the number of silanol groups present on the surface of, and inside, the silica fine powder is small and the silica results in a small amount of production residues such as $Na_2O$ and $SO_3^{2-}$. In addition, in production steps for the dry silica, combined use of any other metal halide such as aluminum chloride or titanium chloride and the silicon halide can provide a composite fine powder of silica and any other metal oxide, and the composite fine powder is also included in the category of the dry silica.

The inorganic fine powder having a number average primary particle diameter of 4 to 80 nm is added in an amount of preferably 0.1 to 3.0 mass % with respect to the toner particles. When the addition amount is less than 0.1 mass %, an effect of the addition is not sufficient. When the addition amount is 3.0 mass % or more, the fixing performance of the toner tends to reduce. The content of the inorganic fine powder can be determined with a calibration curve created from a standard sample by fluorescent X-ray analysis.

As described above, the inorganic fine powder is preferably subjected to a hydrophobic treatment in order that the environmental stability of the toner may be improved. When the inorganic fine powder added to the toner absorbs moisture, the charge quantity of each toner particle tends to reduce, and is apt to be nonuniform, and the scattering of the toner is apt to occur.

A treatment agent to be used in the hydrophobic treatment for the inorganic fine powder is, for example, a silicone varnish, any one of the various denatured silicone varnishes, a silicone oil, any one of the denatured silicone oils, a silane compound, a silane coupling agent, any other organic silicon compound, or an organic titanium compound. One kind of those treatment agents may be used alone, or two or more kinds of them may be used in combination.

Of the above hydrophobic treatments, a treatment with a silicone oil is preferable, and the following treatment is more preferable: the inorganic fine powder is treated with a silicone oil simultaneously with or after a hydrophobic treatment for the inorganic fine powder with a silane compound. A method for the latter treatment is specifically, for example, a method involving: performing a silylation reaction with the silane compound as a first-stage reaction to eliminate silanol groups by chemical bonding; and performing the formation of a hydrophobic thin film on the surface of the inorganic fine powder from the silicone oil as a second-stage reaction after the first-stage reaction.

The above silicone oil has a viscosity at 25° C. of preferably 10 to 200,000 $mm^2/s$, or more preferably 3,000 to 80,000 $mm^2/s$. When the viscosity is less than 10 $mm^2/s$, the inorganic fine powder has no stability, and the quality of an image formed with the toner tends to deteriorate owing to heat and a mechanical stress. In addition, when the viscosity of the silicone oil exceeds 200,000 $mm^2/s$, it tends to be difficult to treat the inorganic fine powder uniformly.

Examples of silicone oil to be used include dimethyl silicone oil, methylphenyl silicone oil, α-methylstyrene-denatured silicone oil, chlorophenyl silicone oil, and fluorine-denatured silicone oil.

Examples of a method for treatment of the inorganic fine powder with silicone oil include a method involving directly mixing an inorganic fine powder treated with a silane compound and silicone oil by using a mixer such as a Henschel mixer, and a method involving spraying an inorganic fine powder with silicone oil. Alternatively, a method involving dissolving or dispersing silicone oil into an appropriate solvent and adding and mixing an inorganic fine powder to and with the solution to remove the solvent is also permitted. The method involving spraying is more preferable in that the amount of an agglomerate of the inorganic fine powder to be generated is relatively small.

100 parts by mass of the inorganic fine powder are treated with the silicone oil in an amount of preferably 1 to 40 parts by mass, or more preferably 3 to 35 parts by mass. When the amount of the silicone oil is excessively small, the inorganic fine powder cannot obtain good hydrophobicity. When the amount is excessively large, a problem such as the occurrence of fogging tends to arise.

The above inorganic fine powder has a specific surface area measured by a BET method based on nitrogen adsorption in the range of preferably 20 to 350 $m^2/g$, or more preferably 25 to 300 $m^2/g$ in order that good flowability may be imparted to the toner. The specific surface area is calculated in accordance with the BET method with a specific surface area measuring apparatus AUTOSORB 1 (manufactured by Yuasa Ionics Inc.) by employing a BET multipoint method while causing a nitrogen gas to adsorb to the surface of the sample.

Any other additive can be additionally used in the magnetic toner of the present invention to such an extent that substantially no adverse effect is exerted on the magnetic toner. Examples of the additive include: lubricant powders such as a fluorine resin powder, a zinc stearate powder, and a polyvinylidene fluoride powder; abrasives such as a cerium oxide powder, a silicon carbide powder, and a strontium titanate powder; caking inhibitors; and organic and inorganic fine particles opposite in polarity as developing performance-improving agents. The surface of any such additive may be subjected to a hydrophobic treatment before use.

Next, an example of an image-forming apparatus in which the magnetic toner of the present invention can be suitably used will be specifically described with reference to FIG. 1. In FIG. 1, an electrostatic latent image bearing member (which may hereinafter be referred to as "photosensitive member" or "image bearing member") 100 is provided with, for example, a contact charging member (charging roller) 117, a developing device 140 having a toner carrying member 102, a transfer charging roller 114, a cleaner 116, and a register roller 124 around itself. The electrostatic latent image bearing member 100 is charged to, for example, −600 V by the charging roller 117 (a voltage applied to the member is composed of, for example, an AC voltage of 1.85 kVpp and a DC voltage of −620 Vdc). Then, the electrostatic latent image bearing member 100 is irradiated with laser light 123 from a laser generator 121, whereby exposure is performed. As a result, an electrostatic latent image corresponding to a target image is formed. The electrostatic latent image on the electrostatic latent image bearing member 100 is developed with a one-component toner by the developing device 140, whereby a toner image is obtained. The toner image is transferred onto a transfer material by the transfer roller 114 abutting the electrostatic latent image bearing member through the transfer material. The transfer material bearing the toner image is transported to a fixing unit 126 by a transport belt 125 or the like, whereby the toner image is fixed on the transfer material. In addition, part of the toner remaining on the electrostatic latent image bearing member is cleaned by the cleaner 116.

A contact charging apparatus having the following characteristic is used in a charging step in an image-forming method of the present invention: an electrostatic latent image bearing member as a body to be charged and as an image bearing member, and a conductive charging member of, for example, a roller type (charging roller), a fur brush type, or a blade type (charging blade) are brought into contact with each other while an abutting portion is formed between them, and a predetermined charging bias is applied to the contact charging member so that the surface of the electrostatic latent image bearing member is charged to a predetermined polarity and a predetermined potential. In addition, such contact charging exerts the following effects: the surface of the electrostatic latent image bearing member can be stably and uniformly charged, and, furthermore, the generation of ozone can be reduced.

In general, however, when a fixed type charging member is used, it is difficult to maintain contact between the charging member and a rotating image bearing member uniformly, so charging unevenness is apt to occur. Accordingly, a charging member (charging roller) which rotates in the same direction as that of the image bearing member is more preferably used in order that contact between the charging member and the image bearing member may be uniformly maintained and the image bearing member may be uniformly charged.

Preferable process conditions when the charging roller is used are as follows: the contact pressure at which the charging roller abuts the image bearing member is 4.9 to 490.0 N/m (5.0 to 500.0 g/cm), and a DC voltage or a voltage obtained by superimposing an AC voltage on a DC voltage is used. When the AC voltage is superimposed, the AC voltage preferably has an amplitude of 0.5 to 5.0 kVpp and an AC frequency of 50 to 5 kHz, and the absolute value of the DC voltage is preferably 200 to 1,500 V. It should be noted that the polarity of each voltage varies depending on the image-forming method to be employed.

A sinusoidal wave, a rectangular wave, a delta wave, or the like can be appropriately used as the wave form of the AC voltage to be used in the charging step. A pulse wave formed by periodically turning a DC power supply on and off is also permitted. As described above, such a bias that a voltage value for the bias changes periodically can be used as the wave form of the AC voltage.

A material for the charging roller member is not limited to an elastic foam, and an elastic material such as ethylene-propylene-diene-polyethylene (EPDM), urethane, a butadiene-acrylonitrile rubber (NBR), a silicone rubber, a rubber material obtained by dispersing a conductive substance such as carbon black or a metal oxide in an isoprene rubber or the like for resistance adjustment, or a product obtained by blowing anyone of these materials can be used. Alternatively, the resistance adjustment can be performed by using an ion conductive material without dispersing, or in combination with, a conductive particle.

In addition, a mandrel to be used in the charging roller member is made of, for example, aluminum or SUS. The charging roller member is provided so as to be brought into press contact with a body to be charged as an image bearing member at a predetermined pressure against elasticity so that a charging abutting portion as a portion where the charging roller member and the image bearing member abut each other is formed.

Next, a contact transferring step to be preferably applied in the image-forming method of the present invention will be specifically described.

The contact transferring step is such that a toner image is electrostatically transferred onto a recording medium while an electrostatic latent image bearing member abuts a transfer member through the recording medium. The contact pressure at which the electrostatic latent image bearing member abuts the transfer member is preferably 2.9 N/m (3.0 g/cm) or more, or more preferably 19.6 N/m (20.0 g/cm) or more in terms of a linear pressure. When the linear pressure as the contact pressure is less than 2.9 N/m (3.0 g/cm), a shift upon transport of the recording medium or a transfer failure tends to be apt to occur.

In addition, when a contact transferring method is applied, the image-forming method of the present invention is employed particularly effectively in an image-forming apparatus having an electrostatic latent image bearing member the diameter of which is as small as 50 mm or less. This is because of the following reason: in the case of an electrostatic latent image bearing member having a small diameter, the curvature of the electrostatic latent image bearing member increases, and a pressure easily converges on the portion where the electrostatic latent image bearing member and the transfer member abut each other when the linear pressure is kept constant. The same phenomenon as that described above may occur even in a belt-like electrostatic latent image bearing member: the present invention is effective in an image-forming apparatus in which the radius of curvature of an electrostatic latent image bearing member at a transfer portion is 25 mm or less as well.

In addition, in the image-forming method of the present invention, the following procedure is preferably adopted in order that such high image quality that no fogging occurs may be obtained: a magnetic toner is applied onto the toner carrying member to have a thickness smaller than the distance of closest approach between the toner carrying member and the electrostatic latent image bearing member (S-D distance), and is developed in a developing step. In general, the thickness of the toner layer on the toner carrying member is controlled by a toner layer thickness control member (such as a magnetic cut or control blade) for controlling the magnetic toner on the toner carrying member; in the present invention, the toner layer thickness control member preferably controls the thickness by abutting the toner carrying member through the magnetic toner. A control blade is generally used as the toner layer thickness control member which abuts the toner carrying member, and the control blade can be suitably used in the present invention as well.

A state where the above control blade is brought into abutment with the toner carrying member to control the thickness of the toner layer exerts an improving effect on the transfer efficiency of the toner and a reducing effect on fogging. This is probably because of the following reasons: a material for the control blade can be designed in accordance with the charging performance of the toner, and, since the control blade abuts the toner carrying member at a specific contact pressure, the toner is subjected to sufficient triboelectric charging, so the toner has an increased charge quantity and obtains uniform charging performance. In addition, when fogging is suppressed and the transfer efficiency is improved as described above, good cleaner-less property is maintained, an image defect such as a charging failure does not occur, and high-definition images can be maintained even when the toner is used over a long time period.

A rubber elastic body made of, for example, a silicone rubber, a urethane rubber, or NBR, or a synthetic resin elastic body made of, for example, polyethylene terephthalate can be used in the above control blade, and, furthermore, a composite of these elastic bodies can also be used; the rubber elastic body is preferable.

A material for the control blade is greatly involved in the charging of the toner on the toner carrying member. Accordingly, when an elastic body is used in the control blade, an organic or inorganic substance may be added to the elastic body, may be melted and mixed into the elastic body, or may be dispersed in the elastic body. Examples of the substance to be added include a metal oxide, a metal powder, ceramic, a carbon allotrope, a whisker, an inorganic fiber, a dye, a pigment, and a surfactant. Further, a product obtained by the following procedure may be used: a charge control substance such as a resin, a rubber, a metal oxide, or a metal is attached to an elastic support made of, for example, a rubber, a synthetic resin, or a metal elastic body so as to abut a portion where the elastic support and the toner carrying member abut each other for the purpose of controlling the charging performance of the toner. In addition, a product obtained by sticking a resin or a rubber to a metal elastic body so as to abut a portion where the metal elastic body and the toner carrying member abut each other is preferable.

When the toner is negatively chargeable, a product which tends to be positively charged such as a urethane rubber, a urethane resin, a polyamide resin, or a nylon resin is preferably used as a material for the control blade or as the charge control substance. When the toner is positively chargeable, a product which tends to be negatively charged such as a urethane rubber, a urethane resin, a silicone rubber, a silicone resin, a polyester resin, a fluorine-based resin, or a polyimide resin is preferably used as a material for the control blade or as the charge control substance.

In the case of a molded body the portion of which abutting the toner carrying member is made of a resin or rubber, a metal oxide such as silica, alumina, titania, tin oxide, zirconia oxide, or zinc oxide, carbon black, or a charge control agent to be generally used in toner is preferably incorporated into the molded body in order that the charging performance of the toner may be adjusted.

A base portion as the upper edge portion side of the control blade is fixed and held on a developing device side, and the lower edge portion side of the blade is brought into abutment with the surface of the toner carrying member at a moderate elastic pressure in a state of being deflected in the forward direction or reverse direction of the toner carrying member against the elastic force of the blade.

The contact pressure at which the control blade and the toner carrying member abut each other is effectively 0.98 N/m (1 g/cm) or more, preferably 1.27 to 245.00 N/m (3 to 250 g/cm), or more preferably 4.9 to 118.0 N/m (5 to 120 g/cm) in terms of a linear pressure in the bus line direction of the toner carrying member. When the contact pressure is smaller than 0.98 N/m (1 g/cm), it becomes difficult to apply the toner uniformly, and the difficulty is apt to be responsible for fogging and scattering. When the contact pressure exceeds 245 N/m (250 g/cm), a large pressure is applied to the toner, so the deterioration of the toner tends to be apt to occur.

The amount of the magnetic toner layer on the toner carrying member is preferably 7.0 g/m$^2$ or more and 18.0 g/m$^2$ or less, or more preferably 9.0 g/m$^2$ or more and 16.0 g/m$^2$ or less.

When the amount of the toner on the toner carrying member is smaller than 7.0 g/m$^2$, a sufficient image density is hardly obtained. This is because of the following reason: although the amount of the toner to be developed onto the electrostatic latent image bearing member is determined by the product of the amount of the toner on the toner carrying member, a ratio of the circumferential speed of the toner carrying member to the circumferential speed of the electrostatic latent image bearing member, and the developing efficiency of the toner, a sufficient amount of the toner cannot be developed irrespective of the extent to which the developing efficiency is improved when the amount of the toner on the toner carrying member is small.

On the other hand, when the amount of the toner on the toner carrying member is larger than 18.0 g/m$^2$, it seems that a sufficient image density can be obtained even when the developing efficiency is low. In actuality, however, it tends to be difficult to charge the toner uniformly, so the developing efficiency is not improved, and a sufficient image density is hardly obtained. In addition, uniform charging performance of the toner is apt to be impaired, so the following tendency is observed: the transferring performance of the toner reduces, and an increase in fogging is prompted.

It should be noted that, in the present invention, the amount of the toner on the toner carrying member can be arbitrarily changed by changing the surface roughness (Ra) of the toner carrying member, the free length of the toner control blade, and the contact pressure at which the toner control blade abuts the toner carrying member. In addition, the amount of the toner on the toner carrying member is measured as described below. A thimble is mounted on a suction port having an outer diameter of 6.5 mm. The resultant is attached to a cleaner, and the toner on the toner carrying member is absorbed while being sucked. The amount of the toner on the toner carrying member is determined by dividing the amount (g) of the absorbed toner by the area (m$^2$) subjected to the absorption.

In the present invention, the outer diameter of the toner carrying member carrying the magnetic toner is 8.0 mm or more and less than 12.0 mm. It should be noted that the outer diameter of the above toner carrying member includes the thickness of a resin layer or the like to be described later.

When the outer diameter of such toner carrying member as described above is less than 12.0 mm, the following situation can be assumed: the curvature of the toner carrying member is large, and, when the magnetic toner of the present invention having a low surface free energy is used, the toner can be loosened with extreme ease, and the developing performance of the toner is improved.

In addition, the magnetic toner of the present invention has a weight average particle diameter (D4) as large as 8.0 μm or more, so the followability of a developing bias is not very high. As a result, sweeping can be suppressed to a low level because the toner is no longer developed at a portion where the S-D distance becomes abruptly large. Accordingly, compatibility between an improvement in image density and the suppression of sweeping may not be achieved until the toner of the present invention is combined with the toner carrying member having an outer diameter of less than 12.0 mm. Therefore, it is important for the outer diameter of the toner carrying member to be less than 12.0 mm.

When the outer diameter of the toner carrying member is 12.0 mm or more, a high image density can be easily obtained because a developing zone widens. However, sweeping becomes remarkable. Further, the toner carrying member cannot be made sufficiently compact, so a reduction in size of a process unit cannot be achieved. In addition, when the outer diameter of the toner carrying member is less than 8.0 mm, an increase in fogging is prompted because the magnet roller in the toner carrying member cannot obtain a sufficient magnetic force.

Further, the rigidity of the toner carrying member itself reduces, and an image defect such as pitch unevenness due to, for example, deflection of the toner carrying member is apt to occur, so it becomes extremely difficult to use the toner carrying member successfully.

A conductive cylinder (developing roller) formed of a metal or alloy such as aluminum or stainless steel is preferably used as the toner carrying member to be used in the present invention. The conductive cylinder may be formed of a resin composition having a sufficient mechanical strength and sufficient conductivity, or a conductive rubber roller may be used. In addition, the shape of the toner carrying member is not limited to such cylinder as described above, and may be an endless belt which rotates.

The toner carrying member to be used in the present invention preferably has a surface roughness in terms of a JIS center line average roughness (Ra) in the range of 0.60 μm or more and 1.20 μm or less.

When the Ra is 0.60 μm or more and 1.20 μm or less, the amount in which the toner is transported becomes sufficient, the amount of the toner on the toner carrying member can be easily controlled, and the charge quantity of the toner easily becomes uniform.

The JIS center line average roughness (Ra) of the surface of the toner carrying member is measured on the basis of the surface roughness "JIS B 0601" with a Surfcorder SE-3500 manufactured by Kosaka Laboratory Ltd. Conditions for the measurement are as follows: a surface roughness at each of nine points (three points in the circumferential direction of the toner carrying member along each of three lines arranged at an equal interval in the axial direction of the toner carrying member) was measured with a cut-off of 0.8 mm, an evaluation length of 4 mm, and a transport speed of 0.5 mm/s, and the average of the measured values was determined.

The surface roughness of the toner carrying member in the present invention can be set to fall within the above range by, for example, changing the extent to which the surface layer of the toner carrying member is abraded, or adding spherical carbon particles, carbon fine particles, graphite, resin fine particles, or the like to the toner carrying member.

The surface of the toner carrying member in the present invention is preferably coated with a resin layer containing conductive fine particles and/or a lubricant dispersed in itself. The conductive fine particles in the coat layer of the toner carrying member each preferably have a resistivity after pressurization at 11.7 MPa (120 kg/cm$^2$) of 0.5 Ω·cm or less. The conductive fine particles are preferably carbon fine particles, a mixture of carbon fine particles and crystalline graphite, or crystalline graphite. The conductive fine particles each preferably have a particle diameter of 0.005 to 10.000 μm.

As the resin used in the resin layer, for example, thermoplastic resins such as styrene-based resins, vinyl-based resins, a polyethersulfone resin, a polycarbonate resin, a polyphenylene oxide resin, a polyamide resin, a fluoro resin, cellulose-based resins, and acrylic resins, and thermosetting resins such as an epoxy resin, a polyester resin, an alkyd resin, a phenol resin, a melamine resin, a polyurethane resin, a urea resin, a silicone resin, and a polyimide resin, or photocurable resins may be used.

Of those, a resin having releasing property such as a silicone resin or a fluoro resin, a resin having excellent mechanical properties such as polyethersulfone, polycarbonate, polyphenylene oxide, polyamide, a phenol resin, polyester, polyurethane, or a styrene-based resin is preferred. A phenol resin is particularly preferable. The conductive fine particles are used in an amount of preferably 3 to 20 parts by mass per 10 parts by mass of the resin component.

When carbon fine particles and graphite particles are used in combination, the carbon fine particles are used in an amount of preferably 1 to 50 parts by mass per 10 parts by mass of the graphite particles.

The resin layer of the toner carrying member in which the conductive fine particles are dispersed has a volume resistivity of preferably $1\times10^{-6}$ to $1\times10^{6}$ Ω·cm.

It should be noted that the above resin layer has a thickness of preferably 25 μm or less, more preferably 20 μm or less, or still more preferably 4 μm or more and 20 μm or less in order that a uniform thickness may be obtained, but the thickness is not particularly limited to such range.

The surface of the toner carrying member to be used in the present invention has a surface free energy of preferably 35.0 mJ/m$^2$ or more and 60.0 mJ/m$^2$ or less.

In addition, in a dispersion component, a polarity component, and a hydrogen bond component as three components for the surface free energy of the surface of the toner carrying member, the dispersion component accounts for preferably 70% or more, or more preferably 85% or more, of the sum of the three components.

When the surface free energy of the surface of the toner carrying member is larger than 60 mJ/m$^2$, releasing performance between the toner and the toner carrying member deteriorates, so the developing efficiency of the toner tends to reduce. In addition, the melt adhesion of the toner tends to be apt to occur when the toner is used over a long time period. On the other hand, when the surface free energy of the surface of the toner carrying member is smaller than 35 mJ/m$^2$, it becomes difficult to charge the toner uniformly, so a reduction in developing efficiency of the toner, an increase in fogging, or the like tends to be apt to occur. Accordingly, the surface free energy of the surface of the toner carrying member is preferably 35.0 mJ/m$^2$ or more and 60.0 mJ/m$^2$ or less.

In addition, in the dispersion component, the polarity component, and the hydrogen bond component as three components for the surface free energy of the surface of the toner carrying member to be used in the present invention, the dispersion component preferably accounts for 70% or more of the sum of the three components. The ratio of the dispersion component is defined by the following expression (3):

$$\text{ratio of dispersion component} = \text{dispersion component} / \text{surface free energy} \qquad \text{Expression (3)}$$

where the surface free energy is the sum of the dispersion component, the polarity component, and the hydrogen bond component.

In the present invention, the surface free energy of the surface of each of the toner and the toner carrying member is defined by analysis in conformance with the Kitazaki-Hata theory.

Of the above three components for the surface free energy, the dispersion component may be a van der Waals force, the polarity component may be an electrostatic force between polar molecules, and the hydrogen bond component may be a force exerted by a hydrogen bond. Of those, the dispersion component is the weakest intermolecular force, so molecules bonded to each other with the intermolecular force may be easily cut even by a slight force. In the case where this notion is applied to the surface of the toner carrying member, releasing performance between the toner carrying member and the toner may be extremely good when the dispersion component accounts for 70% or more of the sum.

Accordingly, a ratio of 70% or more is preferable because the developing efficiency of the toner is extremely improved as a result of a combination with the fact that a ratio X/A of the surface free energy of the toner carrying member to the surface free energy of the toner is 1.00 or more and 4.00 or less.

It should be noted that the surface free energy of the surface of the toner carrying member can be arbitrarily adjusted depending on, for example, the resin to be used in the coat layer of the toner carrying member, particles in the coat layer, and the surface roughness of the toner carrying member.

For example, the surface free energy can be reduced by incorporating a resin having a small free energy (such as a silicone resin or a fluorine-based resin) or a lubricant (graphite particles) into the resin to be used in the coat layer. The case where the graphite particles are incorporated is particularly preferable because of the following reason: since the graphite particles neither have polar molecules nor produce hydrogen bonds, the ratio of the dispersion component can be increased.

In the present invention, the surface of the toner carrying member carrying the magnetic toner preferably moves in the same direction as the direction in which the surface of the image bearing member moves. In addition, a ratio of the speed at which the toner carrying member moves to the speed at which the image bearing member moves is preferably 1.00 to 1.30. When the ratio is less than 1.00, an image formed with the toner hardly obtains a sufficient density, and tends to show reduced quality. On the other hand, when the speed at which the toner carrying member moves is more than 1.30 times as high as the speed at which the image bearing member moves, the deterioration of the toner is apt to occur, and a reduction in image quality tends to occur owing to the long-term use of the toner.

The toner carrying member to be used in the present invention preferably has a magnet having multiple poles, the magnet being fixed in the toner carrying member, and the number of magnetic poles in the magnet is preferably three to ten.

In the present invention, the developing step is preferably a step of forming a toner image by applying an alternating electric field as a developing bias to the toner carrying member to dislocate the toner to an electrostatic latent image on the electrostatic latent image bearing member, and the applied developing bias may be a voltage obtained by superimposing the alternating electric field on a DC voltage.

A sinusoidal wave, a rectangular wave, a delta wave, or the like can be appropriately used as the wave form of the alternating electric field. A pulse wave formed by periodically turning a DC power supply on and off is also permitted. As described above, such a bias that a voltage value for the bias changes periodically can be used as the wave form of the alternating electric field.

In the present invention, an electrostatic latent image-forming step of forming an electrostatic latent image on the charged surface of the electrostatic latent image bearing member is preferably performed by image exposing means. The image exposing means for the formation of the electrostatic latent image is not limited to laser scanning exposing means for forming a digital latent image, and has only to be such that an electrostatic latent image corresponding to image information can be formed; specifically, the means may be typical analog image exposure or any other light-emitting device such as an LED, or may be a combination of, for example, a light-emitting device such as a fluorescent lamp and a liquid crystal shutter.

Hereinafter, methods of measuring various physical properties of the substances according to the present invention will be described.

<1> Methods of Measuring Weight Average Particle Diameter (D4) of Magnetic Toner The particle diameters of the particles of magnetic toner were measured with a precision grain size distribution measuring apparatus based on a pore electrical resistance method provided with a 100-μm aperture tube "Coulter Counter Multisizer 3" (registered trademark, manufactured by Beckman Coulter, Inc) and dedicated software included with the apparatus "Beckman Coulter Multisizer 3 Version 3.51" (manufactured by Beckman Coulter, Inc) for setting measurement conditions and analyzing measurement data while the number of effective measurement channels was set to 25,000. The weight average particle diameter (D4) of the magnetic toner were calculated by analyzing the measurement data.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

(2) About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass fold is added as a dispersant to the electrolyte solution.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the Contaminon N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner are gradually added to and dispersed in the electrolyte solution in the beaker in the section (4) in a state where the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The Measurement Data is Analyzed with the Dedicated Software Included with the Apparatus, and the Weight Average Particle Diameter (D4) of the toner are calculated. It should be noted that an "average diameter" on the "analysis/volume statistics (arithmetic average)" screen of the dedicated software when the dedicated software is set to show a graph in a vol % unit is the weight average particle diameter (D4).

<2> Measurement of Average Circularity and Mode Circularity of Magnetic Toner

The average circularity and mode circularity of the magnetic toner is calculated by using the following expression after measurement with a flow-type particle image measuring device "FPIA-2100" (manufactured by Sysmex Corporation).

Circularity($Ci$)=Circumferential length of a circle having the same area as the particle projected area/Circumferential length of a particle projected image (Equation 1)

The term "particle projected area" is defined as an area of a binarized particle image, while the term "circumferential length of a particle projected image" is defined as the length of a borderline obtained by connecting the edge points of the particle image. The measurement is performed by using a particle image that has been subjected to image processing at an image processing resolution of 512×512 (a pixel measuring 0.3 μm×0.3 m).

The circularity in the present invention is an indication of the degree of irregularities on a particle. The circularity is 1.000 when the particle has a completely spherical shape. The more complicated the surface shape, the lower the circularity. In addition, the average circularity C which means the average value of a circularity frequency distribution is calculated from the following expression when the circularity (central value) of a divisional point i in a particle size distribution is denoted by ci and the number of measured particles is denoted by m.

$$\text{Average circularity } C = \sum_{i=1}^{m} ci/m \qquad \text{(Equation 2)}$$

In addition, the mode circularity is the circularity having the highest frequency in the circularity frequency distribution.

The measuring apparatus "FPIA-2100", which is used in measurement in the present invention, calculates the average circularity and the mode circularity by: calculating the circularities of the respective particles; classifying the particles into classes, which are obtained by equally dividing the circularity range of 0.4 to 1.00 at an interval of 0.01, depending on the resultant circularities; and calculating the average circularity and the mode circularity by using the central value of each divisional point of each class and the number of the particles measured.

A measurement procedure is as described below. 5 mg of the toner are dispersed in 10 ml of water in which 0.1 mg of a surfactant has been dissolved, whereby a dispersion liquid is prepared. The dispersion liquid is irradiated with an ultrasonic wave (20 kHz, 50 W) for 5 minutes, whereby a dispersion liquid having a particle concentration of 5,000 to 20,000 particles/μl is obtained. The resultant dispersion liquid is subjected to measurement with the apparatus so that the average circularity of the group of particles each having a circle-equivalent diameter of 3 μm or more is determined.

It should be noted that the reason why the circularities of only the group of particles each having a circle-equivalent diameter of 3 μm or more are measured in this measurement is as described below. The group of particles each having a circle-equivalent diameter of less than 3 μm contains the group of the particles of an external additive present independently of the toner particles, so the circularities of the toner particles should be determined with additional accuracy while an influence of such external additive is eliminated. In addition, in order that a variation in circularity may be suppressed, the temperature of an environment where the flow-type particle image analyzer FPIA-2100 is placed is controlled at 23° C.±0.5° C. so that the temperature in the analyzer is in the range of 26 to 27° C. Further, automatic focusing is performed by using 2-μm latex particles at a predetermined time interval, or preferably at an interval of 2 hours.

Further, the measuring apparatus "FPIA-2100" used in the present invention differs from a measuring apparatus "FPIA-1000" which has been conventionally used for calculating a toner shape in the following points: the FPIA-2100 has an increased magnification of a processed particle image and an increased processing resolution of a captured image (256×256→512×512) as compared to the FPIA-1000. Therefore, the FPIA-2100 has increased accuracy of toner shape measurement. As a result, the FPIA-2100 has achieved additionally accurate capture of fine particles. Therefore, in the case where a toner shape must be measured with additional accuracy like the present invention, the FPIA-2100 that can furnish additionally accurate information about the shape is more useful than the FPIA-1000.

<3> Surface Free Energy

The surface free energy of the surface of each of the magnetic toner and the toner carrying member was measured with the following apparatus in accordance with the operation manual of the apparatus by using probe liquids each having three known components for a surface free energy (water, diiodomethane, and ethylene glycol) under the following conditions.

To be specific, a contact angle θ of each of the above probe liquids at the surface of each of the magnetic toner and the toner carrying member was measured with a contact angle meter CA-X ROLL model manufactured by Kyowa Interface Science Co., LTD., and the surface free energy was determined by using the expression based on the Kitazaki-Hata theory.

(i) Detailed conditions for the measurement of the contact angle θ are as described below.

| | |
|---|---|
| Measurement: | droplet method (complete round fitting) |
| Liquid amount: | 1 μl |
| Recognition of droplet impingement: | automatic |
| Image processing: | algorithm-no reflection |
| Image mode: | frame |
| Threshold level: | automatic |

In addition, the contact angle θ of each probe liquid was measured five times, and the average of the five measured values was defined as the contact angle θ of the probe liquid. It should be noted that an FAMAS (manufactured by Kyowa Interface Science Co., LTD.) was used for data analysis.

Hereinafter, the present invention will be described more specifically by way of production examples and examples. However, these examples do not limit the present invention at all. It should be noted that all terms "part(s)" in the following formulations mean "part(s) by mass".

<Production Example of Magnetic Substance 1>

An aqueous solution of ferrous sulfate was mixed with a caustic soda solution in an amount of 1.0 to 1.1 equivalents with respect to the iron element and $SiO_2$ in an amount of 1.20 mass % in terms of the silicon element with respect to the iron element, whereby an aqueous solution containing ferrous hydroxide was prepared. The pH of the aqueous solution was set to 8.0, and the solution was subjected to an oxidation reaction at 85° C. while air was blown into the solution, whereby a slurry liquid having a seed crystal was prepared.

Subsequently, an aqueous solution of ferrous sulfate in an amount of 0.9 to 1.2 equivalents with respect to the original alkali amount (sodium component of caustic soda) was added to the slurry liquid. After that, the pH of the slurry liquid was kept at 8.5, and an oxidation reaction for the liquid was advanced while air was blown into the liquid, whereby a slurry liquid containing a magnetic iron oxide was prepared. The slurry was filtrated, washed, dried, and subjected to a shredding treatment, whereby a magnetic substance 1 having a volume average particle diameter (DV) of 0.22 μm, an intensity of magnetization in a magnetic field of 79.6 kA/m (1,000 Oe) of 66.1 $Am^2/kg$, and a residual magnetization in the magnetic field of 6.0 $Am^2/kg$ was obtained.

<Production Example of Magnetic Substance 2>

An aqueous solution of ferrous sulfate was mixed with a caustic soda solution in an amount of 1.0 to 1.1 equivalents with respect to the iron element, whereby an aqueous solution containing ferrous hydroxide was prepared. The pH of the aqueous solution was set to 8.0, and the solution was subjected to an oxidation reaction at 85° C. while air was blown into the solution, whereby a slurry liquid having a seed crystal was prepared.

Subsequently, an aqueous solution of ferrous sulfate in an amount of 0.9 to 1.2 equivalents with respect to the original alkali amount (sodium component of caustic soda) was added to the slurry liquid. After that, the pH of the slurry liquid was kept at 12.8, and an oxidation reaction for the liquid was advanced while air was blown into the liquid, whereby a slurry liquid containing a magnetic iron oxide was prepared. The slurry was filtrated, washed, dried, and subjected to a shredding treatment, whereby a magnetic substance 2 having a volume average particle diameter (DV) of 0.20 μm, an intensity of magnetization in a magnetic field of 79.6 kA/m (1,000 Oe) of 65.9 $Am^2/kg$, and a residual magnetization in the magnetic field of 9.2 $Am^2/kg$ was obtained.

<Production Example of Toner 1>

| | |
|---|---|
| Styrene/n-butyl acrylate copolymer (molar ratio = 76/24, Tg = 56° C., Mn = 18,000) | 100.0 parts by mass |
| Magnetic Substance 1 | 55.0 parts by mass |
| Polyethylene wax (melting point: 110° C.) | 5.0 parts by mass |
| Iron complex of monoazo dye (T-77, manufactured by HODOGAYA CHEMICAL CO., LTD) | 2.0 parts by mass |

The above materials were mixed with a blender, and the mixture was melted and kneaded with a biaxial extruder heated to 120° C. The kneaded product was cooled and coarsely pulverized with a hammer mill. The coarsely pulverized products were finely pulverized with a jet mill. After that, the finely pulverized products were subjected to air classification, whereby toner particles 1 were obtained. 1.0 part by mass of tetrafluoroethylene resin particles (Rubron L-2 manufactured by Daikin Industries, Ltd.) was added to 100.0 parts by mass of the resultant toner particles 1, and the mixture was subjected to a 3-minute treatment with a HYBRIDIZER (manufactured by NARA MACHINERY CO., LTD.) at 6,000 rpm twice, whereby toner particles 1' were obtained. 100.0 parts by mass of the toner particles 1' and 1.0 part by mass of a hydrophobic silica fine powder obtained by treating silica having a number average primary particle diameter of 12 nm with hexamethyldisilazane and then with silicone oil were mixed with a Henschel mixer (manufactured by Mitsui Miike Machinery Co., Ltd.), whereby Toner 1 having a weight average particle diameter (D4) of 12.3 μm was obtained. Table 1 shows the physical properties of Toner 1.

<Production Example of Toner 2>

Toner 2 was obtained in the same manner as in the production example of Toner 1 except that silicone resin particles (TOSPEARL 103 manufactured by Toshiba Silicones) were used instead of the tetrafluoroethylene resin particles. Table 1 shows the physical properties of Toner 2.

<Production Example of Toner 3>

Toner 3 was obtained in the same manner as in the production example of Toner 1 except that the amount of the tetrafluoroethylene resin particles was changed from 1.0 part by mass to 2.0 parts by mass. Table 1 shows the physical properties of Toner 3.

<Production Example of Toner 4>

Toner 4 was obtained in the same manner as in the production example of Toner 1 except that the amount of the tetrafluoroethylene resin particles was changed from 1.0 part by mass to 3.0 parts by mass. Table 1 shows the physical properties of Toner 4.

<Production example of Toner 5>

Toner 5 was obtained in the same manner as in the production example of Toner 1 except that the amount of the tetrafluoroethylene resin particles was changed from 1.0 part by mass to 0.4 parts by mass. Table 1 shows the physical properties of Toner 5.

<Production Example of Toner 6>

In the production example of Toner 1, 100.0 parts by mass of the resultant toner particles 1, 1.0 part by mass of tetrafluoroethylene resin particles, and 1.0 part by mass of a hydrophobic silica fine powder obtained by treating silica having a number average primary particle diameter of 12 nm with hexamethyldisilazane and then with silicone oil were mixed with a Henschel mixer (manufactured by Mitsui Miike Machinery Co., Ltd.) for 10 minutes, whereby Toner 6 having a weight average particle diameter (D4) of 12.3 μm was obtained. Table 1 shows the physical properties of Toner 6.

<Production Example of Toner 7>

The toner particles 1 obtained in the production example of Toner 1 were loaded into an air stream at 300° C. so as to be subjected to a surface modification treatment, whereby toner particles 7 were obtained. 100.0 parts by mass of the toner particles 7 and 1.0 part by mass of a hydrophobic silica fine powder obtained by treating silica having a number average primary particle diameter of 12 nm with hexamethyldisilazane and then with silicone oil were mixed with a Henschel mixer (manufactured by Mitsui Miike Machinery Co., Ltd.), whereby Toner 7 having a weight average particle diameter (D4) of 12.3 μm was obtained. Table 1 shows the physical properties of Toner 7.

<Production Example of Toner 8>

In the production example of Toner 1, 100.0 parts by mass of the resultant toner particles 1 and 1.0 part by mass of a hydrophobic silica fine powder obtained by treating silica having a number average primary particle diameter of 12 nm with hexamethyldisilazane and then with silicone oil were mixed with a Henschel mixer (manufactured by Mitsui Miike Machinery Co., Ltd.), whereby Toner 8 having a weight average particle diameter (D4) of 12.3 μm was obtained. Table 1 shows the physical properties of Toner 8.

<Production example of Toner 9>

Toner 9 having a weight average particle diameter (D4) of 7.6 μm was obtained in the same manner as in the production example of Toner 1 except that conditions for the pulverization and the classification were changed. Table 1 shows the physical properties of Toner 9.

<Production Example of Toner 10>

Toner 10 having a weight average particle diameter (D4) of 14.6 μm was obtained in the same manner as in the production example of Toner 1 except that conditions for the pulverization and the classification were changed. Table 1 shows the physical properties of Toner 10.

<Production Example of Toner 11>

Toner 11 was obtained in the same manner as in the production example of Toner 1 except that the magnetic substance 1 was changed to the magnetic substance 2. Table 1 shows the physical properties of Toner 11.

<Production Example of Toner 12>

Toner 12 was obtained in the same manner as in the production example of Toner 1 except that the amount of the magnetic substance was changed from 55 parts by mass to 35 parts by mass. Table 1 shows the physical properties of Toner 12.

<Production Example of Toner 13>

Toner 13 was obtained in the same manner as in the production example of Toner 1 except that the amount of the magnetic substance 1 was changed from 55 parts by mass to 70 parts by mass. Table 1 shows the physical properties of Toner 13.

TABLE 1

| Toner physical properties | | | | | | |
|---|---|---|---|---|---|---|
| | Weight average particle diameter (μm) | Average circularity | Mode circularity | Intensity of magnetization ($Am^2/kg$) | Residual magnetization ($Am^2/kg$) | Surface free energy ($mJ/m^2$) |
| Toner 1 | 12.3 | 0.954 | 0.96 | 21.7 | 1.98 | 22.3 |
| Toner 2 | 12.3 | 0.954 | 0.96 | 21.8 | 1.98 | 24.6 |
| Toner 3 | 12.3 | 0.954 | 0.96 | 21.8 | 1.97 | 14.6 |
| Toner 4 | 12.3 | 0.954 | 0.96 | 21.8 | 1.98 | 9.8 |
| Toner 5 | 12.3 | 0.954 | 0.96 | 21.7 | 1.97 | 45.2 |
| Toner 6 | 12.3 | 0.941 | 0.94 | 21.6 | 1.99 | 35.8 |
| Toner 7 | 12.3 | 0.961 | 0.97 | 21.6 | 2.01 | 50.4 |
| Toner 8 | 12.3 | 0.955 | 0.96 | 22.3 | 2.01 | 55.8 |
| Toner 9 | 7.6 | 0.956 | 0.96 | 21.9 | 1.99 | 19.7 |
| Toner 10 | 14.6 | 0.951 | 0.96 | 21.6 | 2.00 | 26.5 |
| Toner 11 | 12.5 | 0.953 | 0.96 | 21.9 | 3.02 | 21.9 |
| Toner 12 | 11.7 | 0.954 | 0.96 | 15.7 | 1.43 | 18.6 |
| Toner 13 | 12.1 | 0.953 | 0.96 | 25.4 | 2.31 | 28.9 |

<Production Example of Toner Carrying Member 1>

A toner carrying member having a resin coat layer on the surface of a substrate was produced as described below.

| | |
|---|---|
| Resol type phenol resin (J325: manufactured by DIC Corporation.) | 250 parts |
| Conductive carbon black (primary average particle size: 15 nm, resistance: $1 \times 10^{-1}\ \Omega \cdot cm$) | 10 parts |
| Graphite particles (particle diameter: 4.2 μm) | 90 parts |
| Compound 1 | 30 parts |
| Conductive spherical particles (NICABEADS ICB0520, manufactured by Nippon Carbon Co., Ltd.) | 30 parts |
| Ethanol | 200 parts |

It should be noted that Compound 1 is represented by the following structural formula (1).

Structural formula (1)

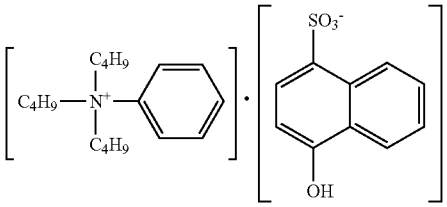

Glass beads each having a diameter of 1 mm were added as media particles to the above materials, and were dispersed with a sand mill for 2 hours. The beads were separated with a sieve, and a solid content was adjusted to 38% with ethanol, whereby an application liquid was obtained. An aluminum cylindrical tube having an outer diameter of 10.0 mmϕ and a center line average roughness Ra of 0.2 μm and subjected to grinding was vertically raised, and was rotated at a constant speed. In addition, the upper and lower end portions of the tube were masked, and the application liquid was applied to the tube while a spray gun was lowered at a constant speed, whereby a resin coat layer was formed. It should be noted that the application was performed under a 23° C./50% RH environment. Subsequently, the resin coat layer was cured by being heated in a hot drying furnace at 150° C. for 30 minutes, whereby a toner carrying member 1 was produced. Table 2 shows the physical properties of the toner carrying member 1.

Here, the outer diameter of the toner carrying member is 10.0 mm because the thickness of the resin coat layer is about 10 to 20 μm.

<Production Example of Toner Carrying Member 2>

A toner carrying member 2 was obtained in the same manner as in the production example of the toner carrying member 1 except that the amount of the conductive spherical particles was changed from 30 parts to 10 parts. Table 2 shows the physical properties of the toner carrying member 2.

<Production Example of Toner Carrying Member 3>

A toner carrying member 2 was obtained in the same manner as in the production example of the toner carrying member 1 except that the amount of the conductive spherical particles was changed from 30 parts to 45 parts. Table 2 shows the physical properties of the toner carrying member 3.

<Production Example of Toner Carrying Member 4>

A toner carrying member 4 was obtained in the same manner as in the production example of the toner carrying member 1 except that the amount of the graphite particles was changed from 90 parts to 45 parts. Table 2 shows the physical properties of the toner carrying member 4.

<Production Example of Toner Carrying Member 5>

A toner carrying member 5 was obtained in the same manner as in the production example of the toner carrying member 1 except that the amount of the graphite particles was changed from 90 parts to 160 parts. Table 2 shows the physical properties of the toner carrying member 5.

<Production Example Of Toner Carrying Member 6>

A toner carrying member 6 was obtained in the same manner as in the production example of the toner carrying member 1 except that the amount of the graphite particles was changed from 90 parts to 160 parts and the amount of Compound 1 was changed from 30 parts to 250 parts. Table 2 shows the physical properties of the toner carrying member 6.

<Production Example of Toner Carrying Member 7>

A toner carrying member 7 was obtained in the same manner as in the production example of the toner carrying member 1 except that the aluminum cylinder having an outer diameter of 10.0 mmϕ was changed to an aluminum cylinder having an outer diameter of 7.6 mmϕ. Table 2 shows the physical properties of the toner carrying member 7.

TABLE 2

| | Outer diameter of toner carrying member (mm) | Average roughness (Ra) (μm) | Surface free energy ($mJ/m^2$) | Ratio of dispersion component (%) |
|---|---|---|---|---|
| Toner carrying member 1 | 10.0 | 0.95 | 51.0 | 89 |
| Toner carrying member 2 | 10.0 | 0.58 | 39.8 | 87 |
| Toner carrying member 3 | 10.0 | 1.22 | 50.6 | 90 |
| Toner carrying member 4 | 10.0 | 0.84 | 60.2 | 91 |
| Toner carrying member 5 | 10.0 | 1.08 | 34.1 | 86 |
| Toner carrying member 6 | 10.0 | 0.99 | 34.8 | 68 |
| Toner carrying member 7 | 7.6 | 0.96 | 45.3 | 88 |

Example 1

An LBP3000 (manufactured by Canon Inc.) was used as an image-forming apparatus, and a cartridge of the apparatus was reconstructed so as to be capable of storing the above toner carrying member 1.

A 2,000-sheet image output durability test was performed under a normal-temperature, normal-humidity environment (23° C./60% RH) by printing horizontal lines each having a print percentage of 3% according to a continuous mode with Toner 1 and the toner carrying member 1 while setting the free length of a toner control blade to 0.7 mm. Evaluation was performed before and after the durability test. It should be noted that A4 paper having a basis weight of 75 $g/m^2$ was used as a recording medium. As a result, the acquisition of images each causing neither sweeping nor fogging to a non-image portion and each having a high density before and after the durability test was attained. Table 3 shows the results of the evaluation.

It should be noted that a method for evaluation for each item performed in each of the examples and comparative examples of the present invention, and criteria for the evaluation will be described below.

<Image Density>

A solid image portion was formed, and its density was measured with a Macbeth reflection densitometer (manufactured by Macbeth Co.).

<Fogging>

A white image was output, and its reflectivity was measured with a REFLECTOMETER MODEL TC-6DS manufactured by Tokyo Denshoku CO., LTD. Meanwhile, the reflectivity of transfer paper (standard paper) before the formation of the white image was similarly measured. A green filter was used as a filter. Fogging was calculated from the reflectivities before and after the output of the white image by using the following expression.

(Expression): fogging (reflectivity) (%)=reflectivity (%) of standard paper−reflectivity (%) of white image sample It should be noted that criteria for fogging are as described below.

A: Very good (less than 1.5%)

B: Good (1.5% or more and less than 2.5%)

C: Normal (2.5% or more and less than 4.0%)

D: Bad (4% or more)

<Sweeping>

Evaluation for sweeping was performed by visual observation in accordance with the following criteria.

A: No sweeping occurs.

B: Sweeping slightly occurs, but is at such a level as to be acceptable.

C: Sweeping occurs at such a level that no problems in practical use arise.

D: Sweeping occurs at an unpreferable level.

Examples 2 to 7

An image output test was performed in the same manner as in Example 1 except that Toner 2, 3, 5, 6, 7, or 11 was used. As a result, each toner provided images at such a level that no problems in practical use arose or higher before and after the durability test. Table 3 shows a combination of a toner and a toner carrying member, and the results of the evaluation.

Comparative Examples 1 to 7

An image output test was performed in the same manner as in Example 1 except that Toner 3, 4, 8, 9, 10, 12, or 13 was used. As a result, each toner provided an image at an unpreferable level in practical use in terms of at least one of an image density, fogging, and sweeping. It should be noted that evaluation was performed by using Toner 3 and the toner carrying member 4 in Comparative Example 5. Table 3 shows a combination of a toner and a toner carrying member, and the results of the evaluation.

TABLE 3

Results 1 of image output test under normal-temperature, normal-humidity environment

| | | Toner carrying Member | X/A | Amount of toner on carrying member ($g/m^2$) | Before duration | | | After duration | | |
|---|---|---|---|---|---|---|---|---|---|---|
| | | | | | Density | Fogging | Sweeping | Density | Fogging | Sweeping |
| Example 1 | Toner 1 | Toner carrying member 1 | 2.29 | 11.5 | 1.48 | A | A | 1.45 | A | A |
| Example 2 | Toner 2 | Toner carrying member 1 | 2.07 | 10.8 | 1.47 | A | A | 1.45 | A | A |

TABLE 3-continued

| Results 1 of image output test under normal-temperature, normal-humidity environment | | | | | | | | | | |
|---|---|---|---|---|---|---|---|---|---|---|
| | | Toner carrying | | Amount of toner on carrying member | Before duration | | | After duration | | |
| | | Member | X/A | (g/m$^2$) | Density | Fogging | Sweeping | Density | Fogging | Sweeping |
| Example 3 | Toner 3 | Toner carrying member 1 | 3.49 | 9.8 | 1.40 | B | A | 1.35 | B | B |
| Example 4 | Toner 5 | Toner carrying member 1 | 1.12 | 12.5 | 1.37 | A | B | 1.34 | B | B |
| Example 5 | Toner 6 | Toner carrying member 1 | 1.42 | 11.0 | 1.35 | B | B | 1.32 | B | C |
| Example 6 | Toner 7 | Toner carrying member 1 | 1.01 | 10.6 | 1.31 | B | B | 1.28 | B | C |
| Example 7 | Toner 11 | Toner carrying member 1 | 2.11 | 11.8 | 1.35 | A | B | 1.31 | A | B |
| Comparative Example 1 | Toner 4 | Toner carrying member 1 | 5.20 | 10.2 | 1.28 | C | B | 1.21 | D | B |
| Comparative Example 2 | Toner 8 | Toner carrying member 1 | 0.83 | 13.5 | 1.26 | B | B | 1.21 | C | C |
| Comparative Example 3 | Toner 9 | Toner carrying member 1 | 2.35 | 12.1 | 1.30 | B | B | 1.23 | B | B |
| Comparative Example 4 | Toner 10 | Toner carrying member 1 | 1.74 | 10.9 | 1.52 | A | C | 1.50 | A | D |
| Comparative Example 5 | Toner 3 | Toner carrying member 4 | 4.11 | 11.0 | 1.29 | B | B | 1.25 | C | B |
| Comparative Example 6 | Toner 12 | Toner carrying member 1 | 2.48 | 8.9 | 1.39 | C | B | 1.32 | D | C |
| Comparative Example 7 | Toner 13 | Toner carrying member 1 | 1.60 | 12.3 | 1.30 | A | B | 1.22 | A | B |

Examples 8 to 12

An image output test was performed in the same manner as in Example 1 except that each of the toner carrying members 2 to 6 was used. As a result, each toner provided images at such a level that no problems in practical use arose or higher before and after the durability test. Table 4 shows a combination of a toner and a toner carrying member, and the results of the evaluation.

Comparative Example 8

An image output test was performed in the same manner as in Example 1 except that the toner carrying member 7 was used. As a result, the image density was low, and fogging was bad. Table 4 shows a combination of a toner and a toner carrying member, and the results of the evaluation.

TABLE 4

| Results 2 of image output test under normal-temperature, normal-humidity environment | | | | | | | | | | |
|---|---|---|---|---|---|---|---|---|---|---|
| | | Toner carrying | | Amount of toner on carrying member | Before duration | | | After duration | | |
| | | Member | X/A | (g/m$^2$) | Density | Fogging | Sweeping | Density | Fogging | Sweeping |
| Example 8 | Toner 1 | Toner carrying member 2 | 1.78 | 6.9 | 1.36 | A | A | 1.32 | A | A |
| Example 9 | Toner 1 | Toner carrying member 3 | 2.27 | 1.83 | 1.46 | B | B | 1.42 | C | B |
| Example 10 | Toner 1 | Toner carrying member 4 | 2.70 | 11.5 | 1.34 | A | B | 1.30 | A | B |
| Example 11 | Toner 1 | Toner carrying member 5 | 1.53 | 10.9 | 1.39 | B | B | 1.34 | C | B |

TABLE 4-continued

| Results 2 of image output test under normal-temperature, normal-humidity environment | | | | | | | | | | |
|---|---|---|---|---|---|---|---|---|---|---|
| | | Toner carrying | | Amount of toner on carrying member | Before duration | | | After duration | | |
| | | Member | X/A | ($g/m^2$) | Density | Fogging | Sweeping | Density | Fogging | Sweeping |
| Example 12 | Toner 1 | Toner carrying member 6 | 1.56 | 12.0 | 1.36 | C | B | 1.32 | C | B |
| Comparative Example 8 | Toner 1 | Toner carrying member 7 | 2.03 | 11.7 | 1.28 | C | B | 1.21 | D | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-283128, filed Oct. 31, 2007, which is hereby incorporated by reference herein in its entirety.

What is claimed is:

1. An image-forming method, comprising:

a charging step of charging an electrostatic latent image bearing member with a charging member to which a voltage is applied;

an electrostatic latent image-forming step of writing image information as an electrostatic latent image on the charged electrostatic latent image bearing member;

a developing step involving forming a toner layer on a toner carrying member carrying magnetic toner and having an outer diameter in a range from 8.0 mm to less than 12.0 mm with a toner layer thickness control member brought into abutment with the toner carrying member, and dislocating the magnetic toner to the electrostatic latent image in a developing portion which is formed by placing the electrostatic latent image bearing member and the toner carrying member with a gap between the electrostatic latent image bearing member and the toner carrying member and to which an alternating electric field is applied to form a toner image;

a transferring step of transferring the formed toner image onto a recording medium; and a fixing step of fixing the transferred toner image, the electrostatic latent image bearing member repeatedly undergoing image formation on itself, wherein:

the magnetic toner has a weight average particle diameter (D4) in a range from 8.0 μm to 14.0 μm;

the magnetic toner has an intensity of magnetization in a magnetic field of 79.6 kA/m (1,000 Oe) in a range from 16.0 $Am^2/kg$ to 25.0 $Am^2/kg$;

the toner carrying member has a surface roughness in terms of a JIS center line average roughness (Ra) in a range from 0.60 μm to 1.20 μm; and when a surface free energy of a surface of the magnetic toner is represented by A ($mJ/m^2$) and a surface free energy of a surface of the toner carrying member is represented by X ($mJ/m^2$), A and X satisfy the following expressions (1), (2) and (3):

$$1.00 \leqq X/A \leqq 4.00; \quad (1)$$

$$10.0 mJ/m^2 \leqq A \leqq 55.0 mJ/m^2; \text{ and} \quad (2)$$

$$35.0 mJ/m^2 \leqq X \leqq 60.0 mJ/m^2. \quad (3)$$

2. An image-forming method according to claim 1, wherein a residual magnetization of the magnetic toner when the magnetic toner is polarized in a magnetic field of 79.6 kA/m (1,000 Oe) is 3.0 $Am^2/kg$ or less.

3. An image-forming method according to claim 1, wherein the magnetic toner has an average circularity of 0.950 or more and a mode circularity of 0.96 or more.

4. An image-forming method according to claim 1, wherein an amount of the magnetic toner layer on the toner carrying member is in a range from 7.0 $g/m^2$ to 18.0 $g/m^2$.

5. An image-forming method according to claim 1, wherein, in a dispersion component, a polarity component, and a hydrogen bond component as three components of the surface free energy of the surface of the toner carrying member defined by analysis in conformance with Kitazaki-Hata theory, the dispersion component accounts for 70% or more of a sum of the three components.

* * * * *